US005348074A

United States Patent [19]

Streubel

[11] Patent Number: 5,348,074

[45] Date of Patent: Sep. 20, 1994

[54] PROCESS AND A DEVICE FOR CONTINUOUS CASTING OF SLABS OR INGOTS

[75] Inventor: Hans Streubel, Erkrath, Fed. Rep. of Germany

[73] Assignee: SMS Schloemann-Siemag Aktiengesellshaft, Deutschland, Fed. Rep. of Germany

[21] Appl. No.: 979,596

[22] Filed: Nov. 20, 1992

[30] Foreign Application Priority Data

Nov. 26, 1991 [DE] Fed. Rep. of Germany ..... 4138740

[51] Int. Cl.[5] ..... B22D 11/128

[52] U.S. Cl. ..... 164/476; 164/454; 164/484; 164/413; 164/442; 164/448

[58] Field of Search ..... 164/454, 476, 484, 413, 164/441, 442, 447, 448

[56] References Cited

U.S. PATENT DOCUMENTS

| | | | |
|---|---|---|---|
| 3,891,025 | 6/1975 | Bollig et al. | 164/413 |
| 3,946,798 | 3/1976 | Uchimoto et al. | 164/448 |
| 4,056,140 | 11/1977 | Ives et al. | 164/448 |

FOREIGN PATENT DOCUMENTS

| | | | |
|---|---|---|---|
| 0194656 | 9/1986 | European Pat. Off. | 164/448 |
| 0007575 | 2/1985 | Japan | 164/448 |
| 0127147 | 6/1987 | Japan | 164/448 |
| 0075158 | 3/1989 | Japan | 164/484 |
| 0205861 | 8/1989 | Japan | 164/454 |

*Primary Examiner*—P. Austin Bradley
*Assistant Examiner*—Erik R. Puknys
*Attorney, Agent, or Firm*—Wolf, Greenfield & Sacks

[57] ABSTRACT

In a process and apparatus for the continuous casting of slabs and blooms which uses a soft-reduction line including a pair of movable rollers arranged in a plane perpendicular to slab movement and a mechanism for driving the rollers towards each other and an adjustable spindle for holding the rollers apart by a desired gap, the load on the spindle is reduced during the spindle adjustment process. This reduction in load may be temporary in which case, after the adjustment is complete and the new gap has been established, the spindle load is retuned to its pre-adjustment value. Alternatively, the spindle can operate in a reduced load condition permanently in which case the desired gap can be set continuously using the reduced-load spindle with only a small spindle adjustment force being necessary.

7 Claims, 4 Drawing Sheets

PROCESS AND A DEVICE FOR CONTINUOUS CASTING OF SLABS OR INGOTS

FIELD OF THE INVENTION

The invention concerns a process and a device for continuous casting of slabs or blooms in a continuous casting plant with a soft-reduction line.

BACKGROUND OF THE INVENTION AND PRIOR ART

Slabs or blooms produced in continuous casting plants are used as the starting material for many rolling mill products, for example, slabs or thin slabs generated by such plants can be used for producing sheets or strips. To reduce segregation in the strand during continuous casting and to obtain better material texture, the strand thickness is generally reduced between 0.5 mm and 3 mm per meter in a soft-reduction line in the final solidification area of the continuous casting plant.

The soft-reduction line is generally of the type in which pairs of rollers can be adjusted individually or in units in relation to one another by means of hydraulic cylinders which apply a pressure to force the pairs of rollers towards each other. The gap between the rollers can be set continuously by means of adjustable spindles which mechanically determine the minimum gap between the rollers. When slabs or blooms are cast continuously, for example, in an arc continuous casting plant, the gap is set according to the strand shrinkage behavior over the length of the machine. In a typical soft-reduction line, the gap of pairs of rollers, individually or combined in units, is gradually reduced along the direction of strand movement depending on the shrinkage behavior of the strand, in order to improve inner quality of the strand material in the area of the final solidification. In this area, bending of the crossbeams and rollers are kept small over the width of the strand by using split rollers, for example.

Each roller of a roller pair is mounted on an upper yoke and the other roller of the roller pair is mounted on a lower yoke which yokes are pulled toward each other by the aforementioned hydraulic cylinders. The yokes can be adjusted relative to one another to change the gap between the rollers by means of rigid, adjustable length spindles which mechanically contact each yoke. With rollers mounted in units, several rollers may be mounted on each yoke and the yokes may be inclined from the inlet toward the outlet, so that the gap on the outlet side is smaller than it is on the inlet side, thereby causing the desired reduction in strand thickness as the strand passes through the roller unit.

In order to improve the strand texture, the strand should run through the soft-reduction area so that the desired reduction in thickness is achieved with a residual liquid phase remaining in the center of the strand during the reduction. Further, the length of the soft-reduction line should be adjusted so that the strand is solidified at the end of the soft-reduction area. In particular, soft reduction does nothing to improve the inner texture of the cast strand and there is no compression of the core texture if the strand is already solidified before it goes into the soft-reduction line or is not solidified by the time it reaches the end in the soft-reduction area.

Due to changing casting parameters, such as, especially, the casting speed, the temperature of the steel, the quality of the steel and secondary cooling, it is often difficult to set the reduction in the soft-reduction area so that the foregoing is achieved. This difficulty occurs because, in a conventional soft-reduction area, the gap must be set during a break in the casting and the gap can be varied to correspond to only a narrow range in casting speed.

It has therefore already been proposed that the gap be adjusted during the casting operation by adjusting the roller spindles depending on the actual casting parameters. This solution has the disadvantage that the spindles and the spindle drive elements used to make the adjustment must be set under load. If a solidified slab is passing between the rollers as the adjustment is being made, the force on the spindles can correspond to the hydraulic cylinder force and therefore, the force needed to make the spindle adjustment can be quite large. In addition, in the case where the strand has not solidified completely upon passing through the rollers, the gap must be set by determining the position of the tip of the liquid core and this position must be found by computer or by other measurement techniques.

Another suggestion to solve the problem is to set the gap continuously via hydraulic cylinders with built-in inductive position-measuring and servo-valves. This solution has the disadvantage that the apparatus is costly and requires a high expense for maintenance. As with the previous prior art approach, the position of the tip of the liquid core must be found by computer or by other measurement techniques in order to set the gap.

Therefore, an object of the invention is to create a process and a device that uses simple means to make it possible to set the gap, even during the casting operation, i.e., under load, especially while adapting to a changing situation in the soft-reduction area due to changing casting parameters.

SUMMARY OF THE INVENTION

The foregoing problems are solved and the foregoing object is achieved in one embodiment of the invention in which the load on the adjustment spindles is reduced during the adjustment process. This reduction in load may be temporary in which case, after the adjustment is complete and the new gap has been established, the spindle load is retuned to its pre-adjustment value. Alternatively, the spindles can operate in a reduced load condition permanently in which case the desired gap can be set continuously using the reduced-load spindles with only a small spindle adjustment force being necessary.

More specifically, if the difference between the hydraulic cylinder force applied to the rollers and the ferrostatic load is measured continuously, the hydraulic pressure of the cylinder can be reduced during casting to such an extent that the load exerted on the spindle corresponds to only a fraction of the normal operating load. For example, the maximum force occurring during conventional operation can be up to 100 t if the strand has solidified, but in accordance with the invention this load can be reduced to only 2 to 3 t so that the gap can be set in a simple way that does not require much spindle drive power.

On the other hand, from the measured load force on the spindle can be determined, where the strand is solidified and where the strand has still a residual liquid core. With the knowledge of the spindle load, the optimum position of the soft reduction area can be determined. This makes it possible to optimize the process quickly in the sense that the precise position in the soft-reduction area and the reduction in thickness, which is based essentially on the casting speed, the secondary cooling and the steel quality, can be established.

The step of reducing spindle load during adjustment allows the spindles to be set inside and outside the cooling chamber of the continuous casting plant at a low load, cost-effectively and safely during operation. Another considerable advantage consists of the fact that the length of the soft-reduction area and the reduction in thickness can be adjusted to the casting speed, i.e., at lower casting speeds, the length of the soft-reduction area can be shortened and the reduction in thickness in mm per meter can be increased. On the other hand, at greater speeds, the length of the soft-reduction area can be increased. Finally, it is possible to set the reduction in thickness within the soft-reduction area in various ways and thus improve the inner quality.

According to one embodiment of the invention, the spindles can be supported on strain gauges. The strain gauges measure the excess load applied to the spindles, which makes it possible to determine the soft-reduction line from the unit pressure or roller-locking pressure, and to control the applied hydraulic pressure in order to make it possible to operate the spindles at reduced load during casting.

According to another embodiment of the invention, the spindles run up against a hydraulic stop, which absorbs any force over the roller locking and adjustment force. Setting the rollers to a new gap in this case requires only releasing the hydraulic pressure in the stop so that the spindles can be set to the new width at reduced load.

More particularly, according to the latter embodiment, the hydraulic stop is a plunger. The plunger is arranged between a spindle and the lower yoke and has a fixed stop that limits the outward travel of the plunger piston. During casting, the hydraulic pressure is introduced into the plunger so that the plunger piston is driven against the fixed stop. This arrangement supports the spindle and allows the casting operation to run with a pressure exceeding the spindle adjustment pressure.

When the gap must be set during casting, the hydraulic pressure in the stop cylinder is released and the spindles can then be adjusted to new dimensions at reduced load. After setting, the stop is again put under pressure until the plunger piston comes to rest against the fixed stop. In this position, the rollers are then located at the desired gap from one another.

The invention will be explained in greater detail using the examples and embodiments shown in the drawings.

DETAILED DESCRIPTION OF THE PREFERRED EMBODIMENTS OF THE INVENTION

Figure 1:
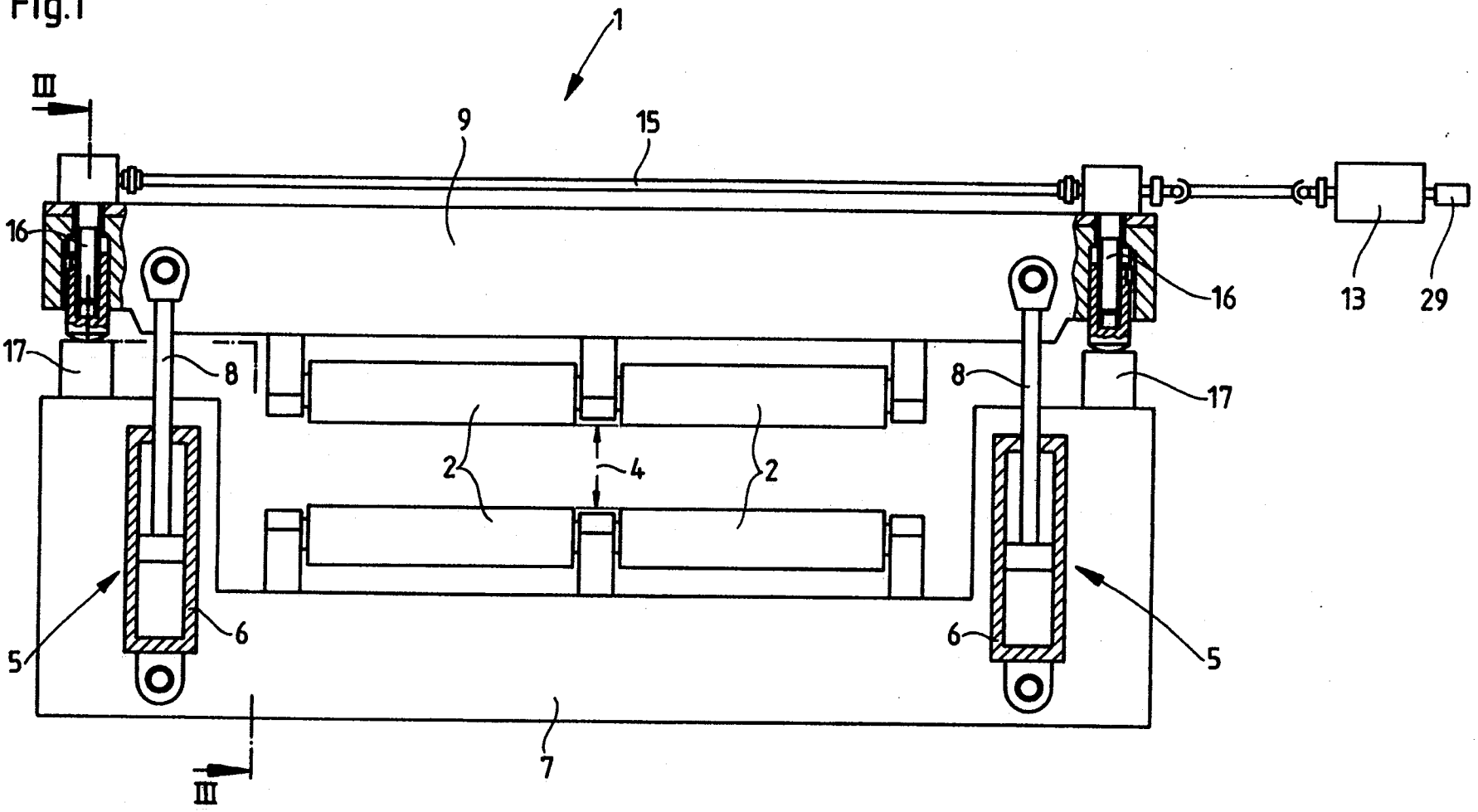
FIG. 1 shows a roller apron segment according to the invention with a front view of the adjustment spindles supported on the strain gauges.

In a continuous casting plant for casting slabs or blooms, not shown in FIG. 1, many rollers 2, arranged individually or in roller apron segments 1, form a guide acting on a strand 3 (see FIG. 3) to be withdrawn and reduced in thickness, if need be. The rollers 2 are supported on an upper yoke 9 and a lower yoke 7. Yokes 7 and 9 and their attached rollers 2 can be moved in relation to one another by means of hydraulic cylinders 5, whose cylinder tube 6 are attached on a lower yoke 7 and whose piston rods 8 act on an upper yoke 9 of the roller apron segment 1, as shown in FIGS. 1 and 2.

At the inlet and outlet 11 and 12 (see FIG. 3) of the roller apron segment 1, adjustment spindles 16 are arranged in pairs and can be adjusted by motors 13, gears 14 and drive shafts 15 (see FIG. 4) in order to set the rollers 2 to the desired gap 4. In the embodiment shown in FIG. 1, spindles 16 are supported on strain gauges 17. In the embodiment illustrated in FIG. 2 spindles 16 are supported on hydraulic stops comprising plunger 21, which are arranged on one surface 19 of the lower yoke 7. Plunger pistons 18 have a lower end 24 of increased diameter. The plunger 21 have a fixed stop 23 against which the lower end 24 can be driven by hydraulic pressure introduced into the plunger space 22.

It is possible by means of both the strain gauges 17 and plunger piston 18 to set the adjusting spindles 16 during casting, i.e., dynamically, since the pressure on the spindles 16 can be released during adjustment. For example, in order to set the gap 4 between two rollers 2 or the gap 25 or 26 (see FIG. 3) for rollers mounted in roller apron segment 1, the pressure of the spindles 16 against the strain gauges 17 can be used to control the hydraulic pressure applied to cylinders 5 in a conventional fashion. This arrangement allows the pressure prevailing in the hydraulic cylinders 5 to be reduced from the conventional working pressure so that the spindles 16 can be set to the new dimensions via the drive (motor 13, gears 14, drive shaft 15) at a reduced load.

Figure 2:
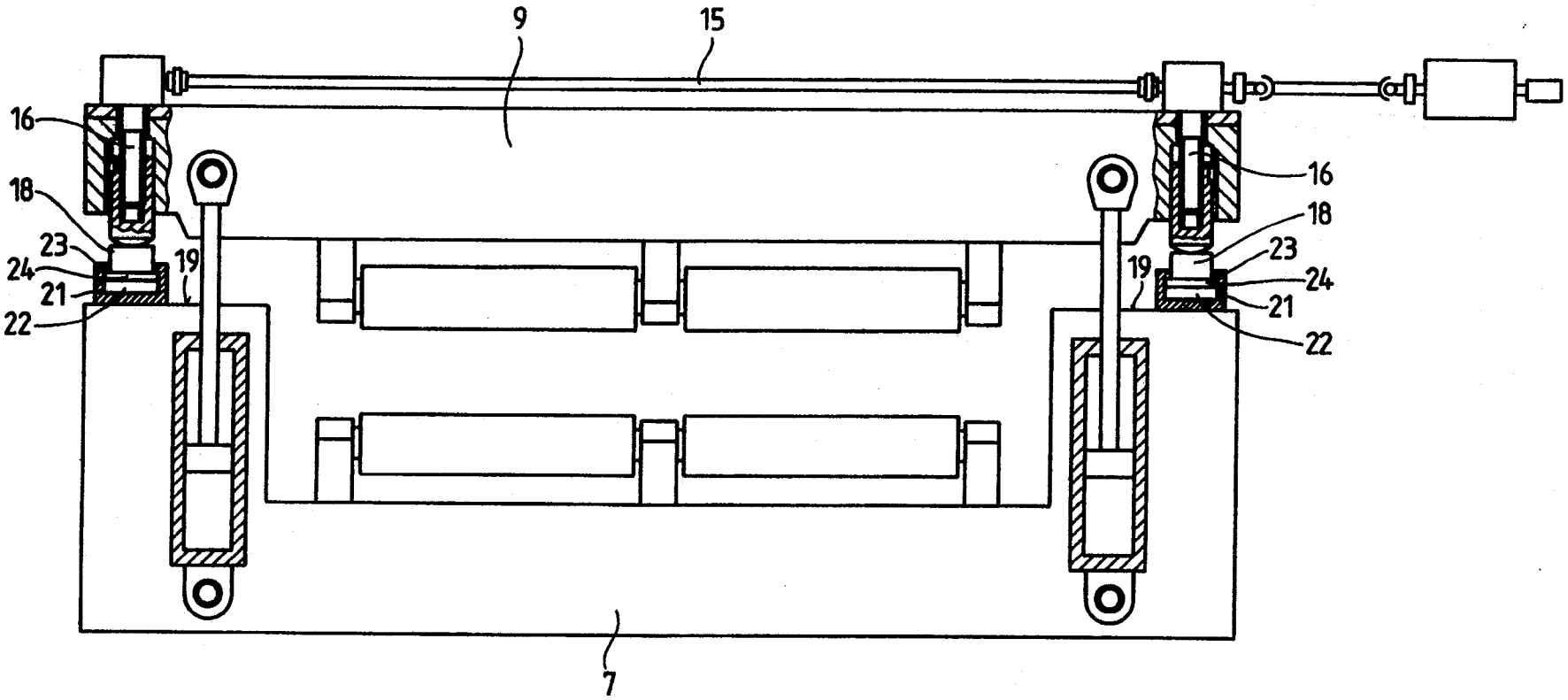
FIG. 2 shows a roller apron segment according to FIG. 1, but with adjustment spindles supported on hydraulic stops.

The same effect, namely setting the spindles 16 at reduced load during casting, is achieved in the embodiment illustrated in FIG. 2 by having the spindles 16 supported on plunger pistons 18, so that during casting, the plunger pistons 18 and their lower end 24 are driven against the fixed stops 23 by hydraulic pressure in the plunger space 22 which pressure generates a force in excess of the applied load force to the spindles 16. To make an adjustment to spindles 16 during casting, the hydraulic pressure in plunger space 22 is released and the spindles 16, relieved of pressure in this way, can be adjusted to new gap 25, 26 and gap 4. Subsequently, hydraulic pressure is applied to plunger space 22 to allow the casting operation to proceed at normal load.

In a continuous casting plant with a soft-reduction area, this reduced-load setting of the spindles 16 makes it possible to adjust the rollers, which must be moved closer together in the soft-reduction area as a result of the shrinkage of the strand, to changing casting parameters, during operation. The soft-reduction area must be located where there is still a residual liquid core 27 in the strand 3 at the start of the area, but the strand is completely solidified (see FIG. 3) at the end of the soft-reduction area. Consequently, the soft-reduction area must be moved upstream or downstream—in relation to the direction in which the tip of the liquid core is moving—as the casting parameters, such as different casting speeds, change.

In the embodiment shown in FIG. 1, the forces applied to the spindles 16 are measured continuously with the strain gauges 17, and the differences in the measured values can be used to tell where the strand 3 still has a residual liquid core 27 and where it is already solidified. If it is established that the desired position of the soft-reduction area has moved, the rollers 2 can be set during casting and adjusted to the position in the soft-reduction area, i.e., set closer there than necessary due to the shrinkage, since the spindles 16 can be set at reduced load.

Figure 3:
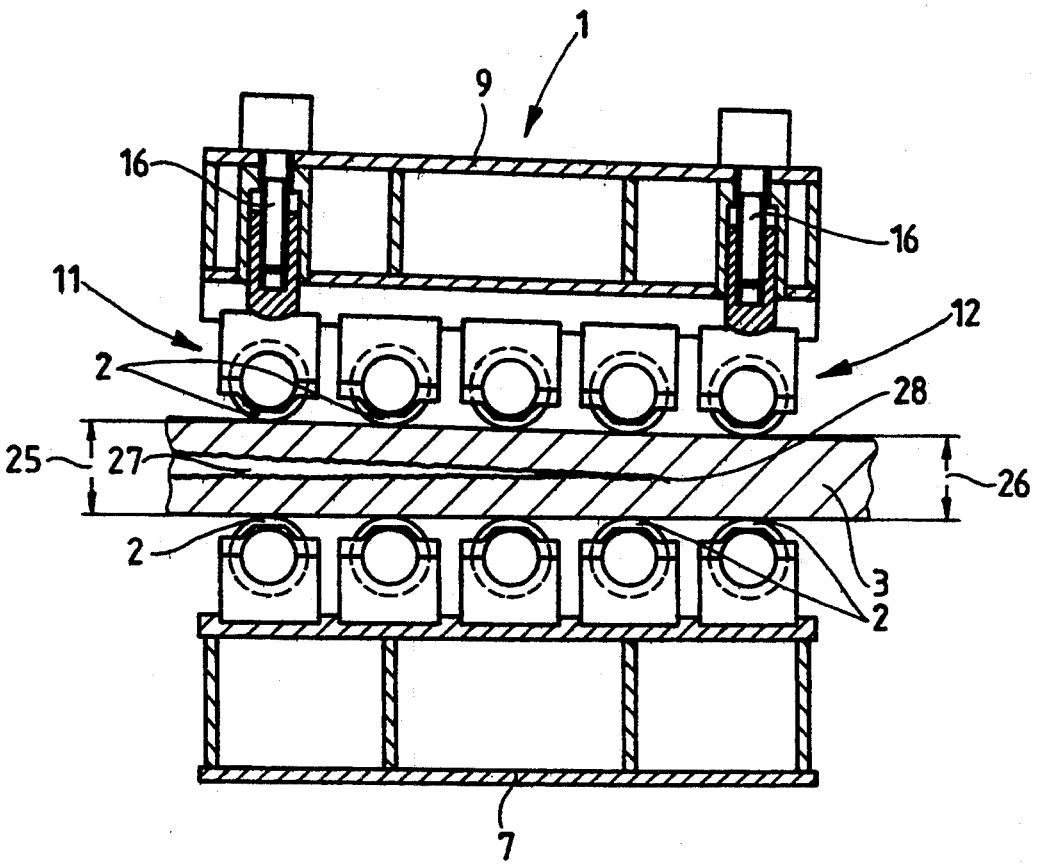
FIG. 3 shows a side view of a roller apron segment according to FIGS. 1 and 2.
Figure 4:
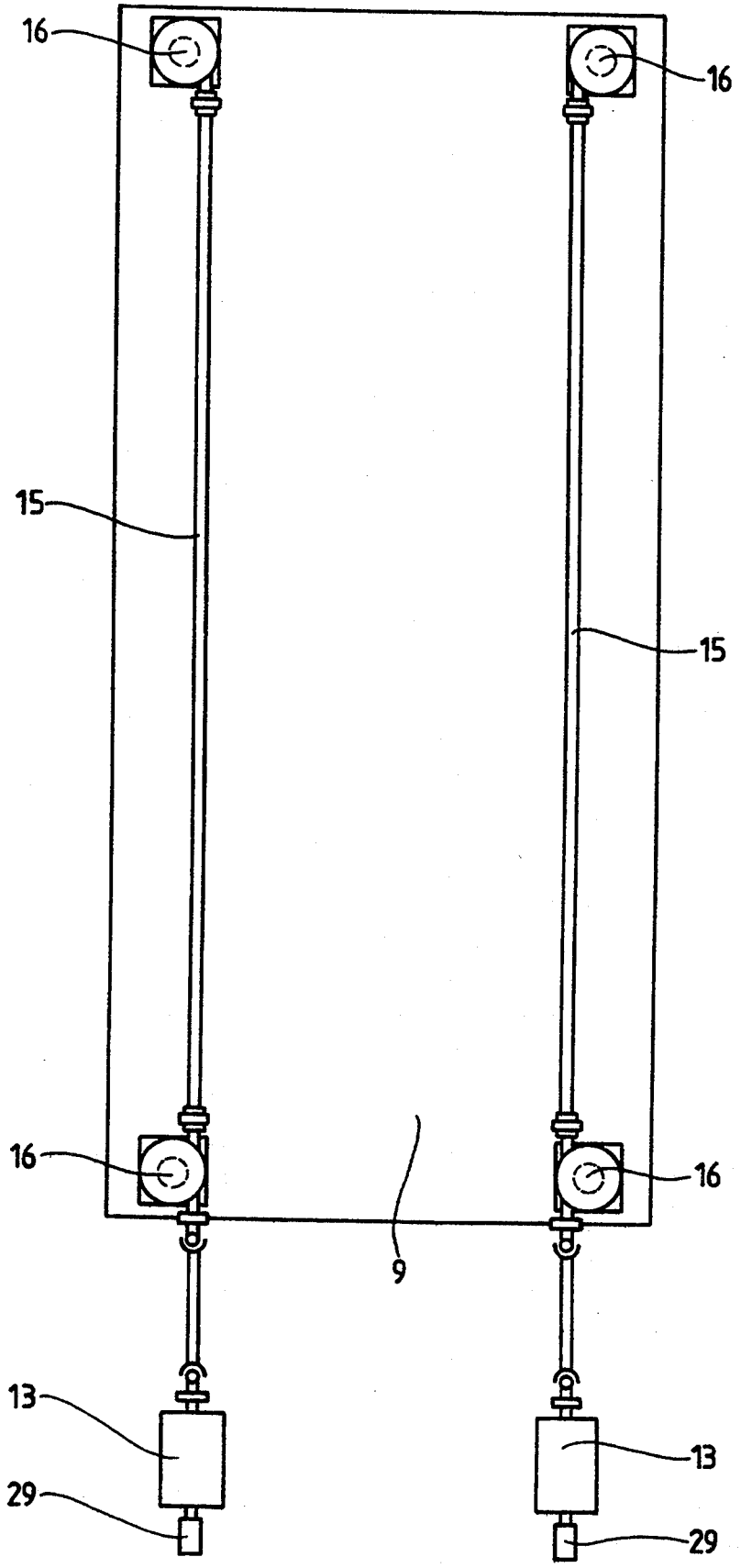
FIG. 4 shows a top view of the roller apron segment in FIG. 3.

If the rollers are mounted in a unit 1, as shown in FIG. 3, because of the measured values, the upper yoke 9 can be inclined toward the outlet 12, so that there is a larger gap 25 at the inlet 11 than at the outlet 12 (see the gap 26 in FIG. 3). The wedge angle can be set in accordance with the residual liquid core 27 in the strand 3 so that, for example, within the soft-reduction area before the final solidification point 28 there is a deformation of the strand 3 with a reduction in strand thickness of 0.5 mm to 3 mm per meter. Because the changing position of the soft-reduction area along the casting flow direction is established and the spindles 16 are set at reduced load during casting, the rollers 2—whether they are set individually or in a unit in relation to one another can always be adjusted to the changing casting parameters and/or the position of final solidification point 28, which changes accordingly.

With rollers 2 mounted in roller apron segments 1, in order for the wedge shape shown in FIG. 3 to be achieved at the outlet 12, position transmitters 29 (see FIG. 4) attached to motors 13 are used to determine the spindle settings. Starting from a calibration value, which is for example set by lowering the upper yoke 9 against fixed stops. These settings are later used to quickly move the yoke 9 to the desired gap 25, 26 at the inlet and outlet 11, 12.

What is claimed is:

1. A process for continuous casting of slabs and blooms in a casting machine by means of a soft-reduction area including at least a pair of movable rollers arranged in a plane perpendicular to the casting direction, a hydraulic cylinder for driving the rollers towards each other and an adjustable spindle for holding the rollers apart by a desired gap, the process comprising the steps of:

A. measuring a force applied to the spindle which keeps the rollers separated;

B. using the force measured in step A to control the hydraulic cylinder to reduce the force to a predetermined value, the predetermined value being substantially less than a value of the force measured in step A; and C. adjusting the spindle respectively to locate the rollers at the desired gap when the force has been reduced to the predetermined value.

2. A process according to claim 1, wherein step A comprises the step of:

A1. continuously measuring the difference between a cylinder force applied by the hydraulic cylinder and a ferrostatic load force generated by the slab and bloom passing through the rollers.

3. A process according to claim 2, wherein step A1 comprises the step of:

A1A. using a pressure gauge to measure a force between the spindle and one of the rollers.

4. A process for continuous casting of slabs and blooms in a casting machine by means of a soft-reduction area including a pair of movable rollers arranged in a plane perpendicular to a casting direction, a hydraulic cylinder for driving the rollers towards each other and an adjustable spindle for holding the rollers apart by a desired gap, the process comprising the steps of:

A. reducing from a normal load value to a predetermined value a force applied to the spindle which keeps the rollers separated, the predetermined value being substantially less than the normal load value;

B. adjusting the spindle when the force has been reduced the predetermined value, by moving an adjustable stop against which the spindle bears from an initial position to a final position as the slab or bloom passes through the rollers; and C. increasing the force to the normal load value to allow casting to continue at the normal load value with the spindle adjusted according to step B.

5. A process according to claim 4 wherein step C comprises the step of:

C1. moving an adjustable stop against which the spindle bears from the final position to the initial position.

6. Apparatus for continuous casting of slabs and blooms in a casting machine by means of a soft-reduction area including a pair of movable rollers arranged in a plane perpendicular to the casting direction, a hydraulic cylinder for driving the rollers towards each other and an adjustable spindle for holding the rollers apart by a desired gap, the apparatus comprising:

a strain gauge for measuring a value of a force applied to the spindle which keeps the rollers separated;

a control apparatus, responsive to the measured force value, for controlling the hydraulic cylinder reduce the force value to a predetermined value, the predetermined value being substantially less than the measured force value; and an adjustment mechanism for adjusting the spindle when the force value has been reduced to the predetermined value, whereby the spindles are adjusted when a force thereon is substantially less than a normal load force applied during casting.

7. A process according to claim 2 further comprising a plurality of pairs of movable rollers arranged in planes perpendicular to the casting direction and wherein the hydraulic cylinder drives each of the plurality of pairs of rollers towards opposing of the plurality of rollers and wherein the adjustable spindle holds the rollers apart by a desired gap and further comprising:

D. adjusting the spindles to control a respective gap of each of the pairs of rollers relative to a location of the soft-reduction line based upon step A1.

* * * * *